United States Patent [19]

DuFresne

[11] Patent Number: 4,625,957

[45] Date of Patent: Dec. 2, 1986

[54] APPARATUS FOR STACKING AND DELIVERING PAPER NAPKINS, PAPER TOWELS, AND THE LIKE

[75] Inventor: Allen J. DuFresne, Green Bay, Wis.

[73] Assignee: Paper Converting Machine Company, Green Bay, Wis.

[21] Appl. No.: 622,097

[22] Filed: Jun. 19, 1984

[51] Int. Cl.[4] ..... B65H 31/00

[52] U.S. Cl. ..... 271/214; 74/393; 198/425; 271/181; 271/202; 414/38

[58] Field of Search ..... 271/214, 215, 181, 903, 271/202, 203, 220, 223; 414/38, 46, 32, 330; 198/425, 426, 576, 577, 579, 859; 474/71; 74/393

[56] References Cited

U.S. PATENT DOCUMENTS

| | | | |
|---|---|---|---|
| 1,129,107 | 2/1915 | Long | 271/181 |
| 2,601,376 | 6/1952 | Eaton | 198/425 |
| 3,019,886 | 2/1962 | Winkler et al. | 198/425 |
| 3,111,312 | 11/1963 | Swanson et al. | 271/181 |
| 3,906,810 | 9/1975 | Gledgening | 474/71 X |
| 4,399,905 | 8/1983 | Lance et al. | 271/903 X |

*Primary Examiner*—Douglas C. Butler
*Assistant Examiner*—Matthew C. Graham
*Attorney, Agent, or Firm*—Tilton, Fallon, Lungmus & Chestnut

[57] ABSTRACT

A stacking and delivery apparatus for stacks of products such as paper napkins and paper towels includes a magazine into which the products are delivered to form stacks and which supports the stack along a path of product movement. A plurality of fingers are mounted on a conveyor adjacent the magazine, and the conveyor moves a finger into the path of stack movement when a stack is completed and separates the completed stack from the next stack. A drive system for the conveyor moves the conveyor at different speeds during each cycle in which a stack is formed—a first, fast speed at which a finger is quickly moved into the path after a stack is completed, a second, relatively slow speed at which the finger moves the completed stack along the path as the next stack is built up behind the finger, a third, relatively fast speed at which the finger moves the completed stack rapidly along the path, and a fourth speed, which can be zero, during which a completed stack is removed from the conveyor.

18 Claims, 11 Drawing Figures

APPARATUS FOR STACKING AND DELIVERING PAPER NAPKINS, PAPER TOWELS, AND THE LIKE

BACKGROUND

This invention relates to a stacking and delivery apparatus, and, more particularly, to a stacking and delivery apparatus for stacks of products such as paper napkins, paper towels, and the like.

Paper napkins, paper towels, and similar products are automatically folded and delivered by well-known and conventional machines For example, Paper Converting Machine Company of Green Bay, Wisc. manufacturers machines known as the Super 6 and the Series 11 for cutting, folding, and delivering paper napkins.

It is desirable to provide a machine for automatically dividing the product into stacks of a specified count and for delivering individual stacks for subsequent handling, such as packaging. U.S. Pat. No. 3,866,905 describes one type of automatic stacking and delivery apparatus. In this machine, separating or count fingers are inserted between individual products when a stack has been completed, and separate transfer fingers then engage the completed stack and move the stack toward the delivery end of the machine. However, the separate count fingers and transfer fingers require rather complex actuating means for moving the fingers at the appropriate times.

SUMMARY OF THE INVENTION

The invention provides an automatic stacking and delivery machine which uses a single set of fingers for both separating a completed stack and for transporting the completed stack. The fingers are mounted on a conveyor which extends along the path of movement of the stacks, and a drive system for the conveyor moves the conveyor and the fingers at several different velocities during each cycle in which a stack is formed. A finger is moved rapidly into the path when a stack has been completed to separate the completed stack from the next stack. The finger is then advanced relatively slowly as the next stack is built up behind the finger. When the next stack has been built up enough to be self-supporting, the finger is advanced rapidly to move the completed stack to a delivery point. The movement of the finger is then stopped to permit the stack to be removed.

A single system controls both count separation and stack transport, and a single cam controls the system. A wide range of counts can be provided merely by changing the single cam.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
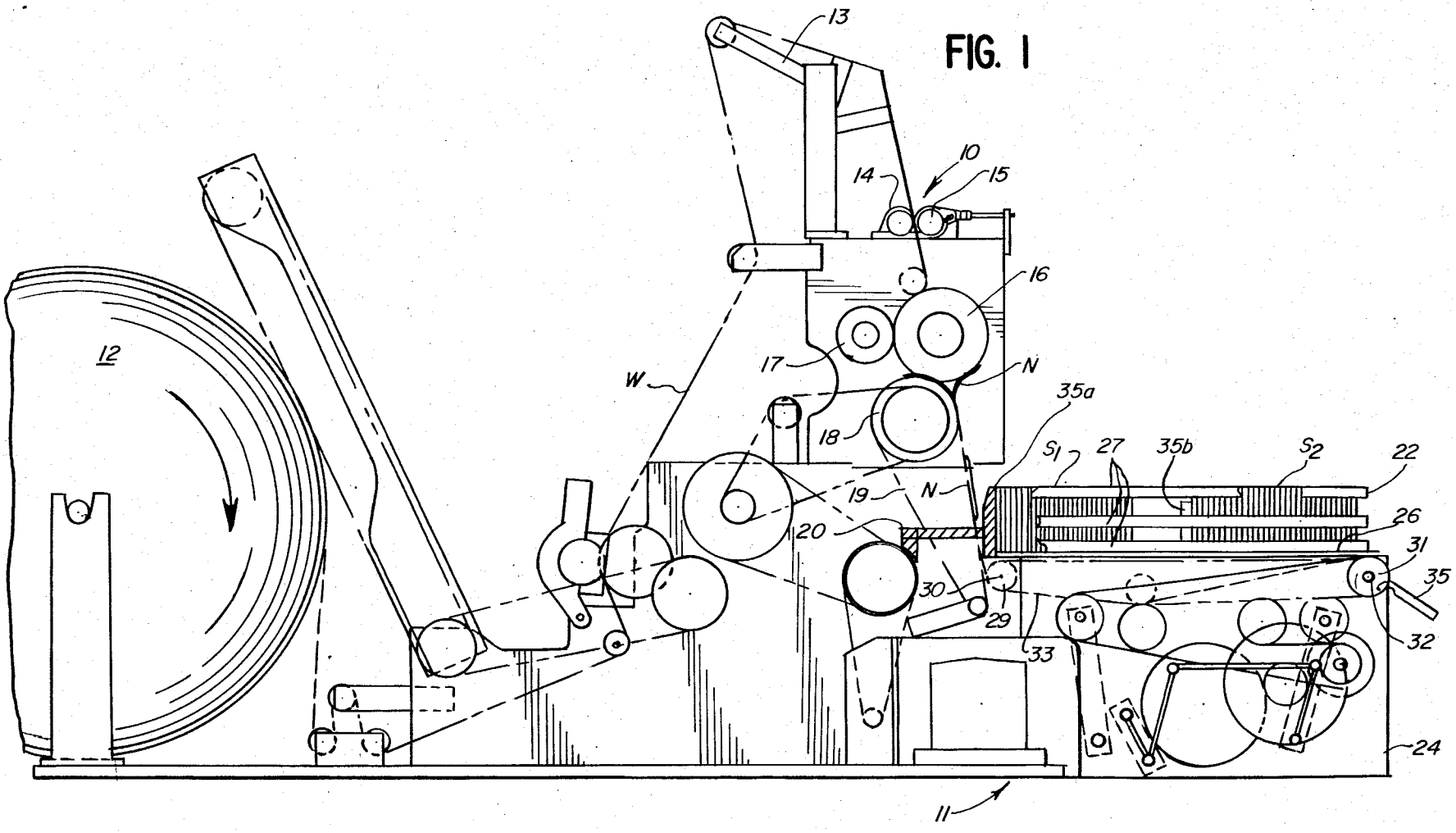
FIG. 1 is a schematic diagram of a napkin folding machine with an automatic stacking and delivery machine formed in accordance with the invention installed to the right.

Referring to FIG. 1, a conventional napkin converting machine 10 folds and delivers paper napkins to a stacking and delivery machine 11. A paper web W is supplied from a parent roll 12, passes over longitudinal folding plates 13 and through a nip roll set 14, 15, and is laid on the surface of a rotating anvil and vacuum carrier roll 16 which works in conjunction with a cutoff roll 17.

Web segments are cut by the cutoff roll 17 to form individual napkins N which are folded in half by the vacuumized co-acting relationship between the vacuum roll 16 and a folding roll 18. A plurality of belts 19 are entrained around the folding roll 18 in axially spaced grooves therein and strip the folded napkins from the folding roll and deliver them downwardly to a delivery position where they are subsequently packed out by an orbital packer 20. Without the automatic stacking and delivery machine, napkins would normally be delivered in continuous superposed relationship along a magazine 22 for manual count separation and transfer to packaging equipment.

The foregoing napkin folding machine 10 and variations thereof, as well as different style packers, are well-known and well-defined in the prior art. The particular napkin folding machine illustrated is a Series 11 machine available from Paper Converting Machine Company.

Figure 2:
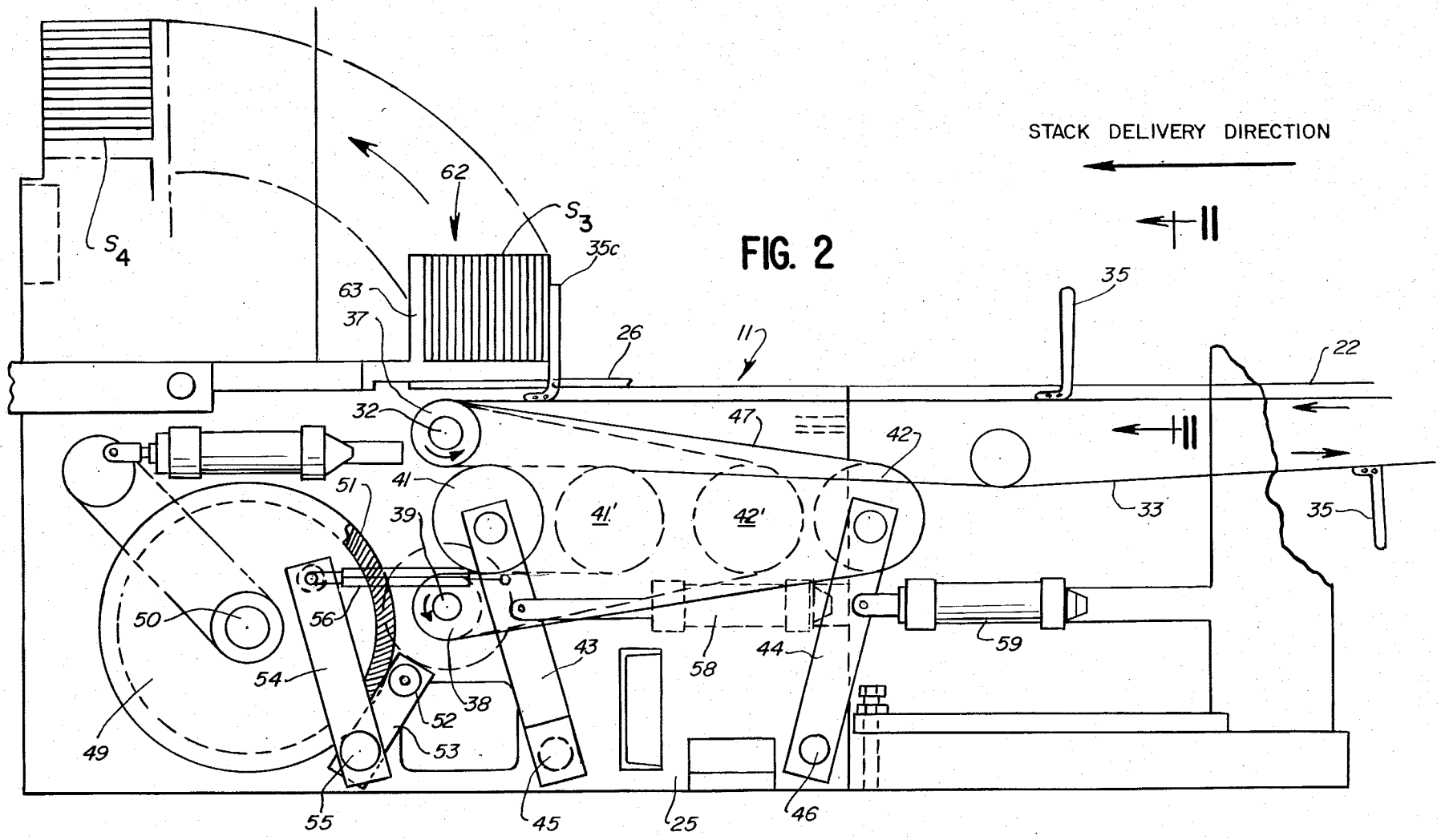
FIG. 2 is an enlarged fragmentary schematic view of the drive system for the stacking and delivery machine as seen from the other side of the machine.

The stacking and delivery machine 11 includes a frame having a pair of spaced-apart side walls 24 and 25 (see also FIG. 2). The magazine 22 is mounted at the top of the side walls and includes a plurality of elongated bottom plates 26 (see also FIG. 11) which are horizontally spaced apart between the side walls and a plurality of elongated, vertically spaced side plates 27 on each side of the magazine. The magazine supports the napkins for movement along a horizontal path away from the orbital packer 20.

A pair of front sprockets 29 are keyed to a shaft 30 which extends between the frame side walls, and a pair of rear sprockets 31 are keyed to a shaft 32. The sprockets are aligned with spaces between the bottom plates 26 of the magazine, and a chain 33 extends around each pair of longitudinally aligned front and rear sprockets 29 and 31. A plurality of fingers 35 are mounted on each chain, and the fingers on each chain extend upwardly through a space between a pair of bottom plates when the fingers are located on the top run of the chain which extends horizontally below the magazine (see FIG. 11).

The drive system for the conveyor chains 33 is illustrated in FIG. 2, which shows the side opposite to that of FIG. 1. A sprocket 37 is keyed to the rear sprocket shaft 32 outside of the side wall 25 of the frame. A driYe sprocket 38 is mounted on a drive shaft 39 which is driven at constant speed by external drive means (not shown) such as a motor, gear connection to the converting machine 10, or the like. A pair of idler sprockets 41 and 42 are mounted on pivotable lever arms 43 and 44, respectively. The lever arm 43 pivots on pin 45, and the lever arm 44 pivots on pin 46. A chain 47 wraps around the drive sprocket 38, the idler sprocket 42, the sprocket 37, and the idler sprocket 41.

A control cam 49 is rotatably mounted on a shaft 50 and rotates continuously, making one revolution for each count cycle. The outer periphery 51 of the cam provides a camming surface which is engaged by a cam follower 52. The cam follower is mounted on a link 53 which is secured to a link 54, and both links are pivotally mounted on the frame by pin 55. A link 56 connects the upper end of link 54 to the lever arm 43 for the idler sprocket 41. Both of the movable sprockets 41 and 42 are located on one side of a line which extends between the sprocket 37 and the drive sprocket 39.

As the cam follower 52 follows the contour of the camming surface, the links 53, 54, and 56 move the sprocket 41 toward or away from the sprocket 42. Since the length of the chain 47 is fixed, as the sprocket 41 moves to the right in FIG. 2, the sprocket 42 is pulled to the left. The limit position of sprockets 41 and 42 are shown in phantom in FIG. 2 at 41' and 42'. The lever arms 43 and 44 for the sprockets are connected to air cylinders 58 and 59, respectively, which bias the lever arms and in effect act as spring take-ups. Accordingly, as the cam follower moves radially inwardly on the cam, the sprocket 41 moves to the left in FIG. 2 and the sprocket 42 moves to the right.

The keyed drive sprocket 38 is rotated continuously at constant speed in the direction indicated by the arrow. However, the idling sprocket 37 which drives the shaft 32 and thus the two conveyor chains 33 can rotate at different speeds depending upon the movement of the sprockets 41 and 42. When the cam follower 52 engages a portion of the cam which has a constant radius, the cam follower and the sprockets 41 and 42 do not move. The chain 33 is therefore driven at a constant speed by the drive sprocket 38. When the radius of the cam increases, the cam follower and the sprocket 41 move to the right, and the chain 47 is pulled around the sprocket 37 at a faster rate, thereby increasing the speed of the conveyer chain 33. When the radius of the cam decreases, the cam follower 52 moves to the left, and the sprockets 41 and 42 move away from each other. The chain 47 then travels around the sprocket 37 at a slower rate, and the conveyor chain 33 slows down. The sprockets 41 and 42 therefore add to or substract from the constant velocity of the chain 47 which is provided at the drive sprocket 38, depending upon the contour of the cam.

In FIG. 1 a pair of fingers **35*a* has just been rotated by the two conveyor chains 33 around the sprockets 29 into a vertical position in the path of movement of the napkins N. As the fingers move past the belts 19, they strip the last napkin from the belts to complete a stack $S_1$ on the magazine. The fingers 35*a* are thereby interjected between two consecutive napkins which are delivered by the belts 19, the last napkin of the completed stack and the first napkin of the next stack. The first napkin of the next stack and subsequent napkins are packed out by the reciprocating packers 20 behind the vertical fingers 35*a***.

It is therefore desirable that the fingers **35*a* move rapidly into their vertical position so that the fingers can be interjected between two napkins without slowing down the delivery speed of the folding roll 18. Once the fingers move into the path of napkin movement, the velocity of the conveyor chains 33 and the fingers is slowed so that the fingers move forwardly at the same rate at which the napkins of the next stack are built up behind the fingers by the packers 20. The fingers thereby provide support against which the napkins of the next stack can be packed. When a sufficient number of napkins of the next stack are packed so that the partial stack is supported, the velocity of the conveyor chains and the fingers is increased so that the fingers 35*a* and the completed stack $S_1$ in front of the fingers are moved rapidly down the magazine. In FIG. 1 the fingers 35*b*** have moved the previous stack $S_2$ toward the delivery end of the magazine.

When a stack reaches the delivery point along the magazine, the conveyor chains 33 and fingers 35 stop and dwell for a discrete period of time to permit the stack to be transferred from the magazine for subsequent handling. FIG. 2 shows a conventional transfer device 62 which includes a bucket 63 which is positioned on the magazine 22 to receive a stack $S_3$ which is being pushed by finger **35*c***. After the stack has been pushed into the bucket and the conveyor chain stops, the bucket is pivoted 90° to move the stack to the position indicated at $S_4$.

Figure 4:
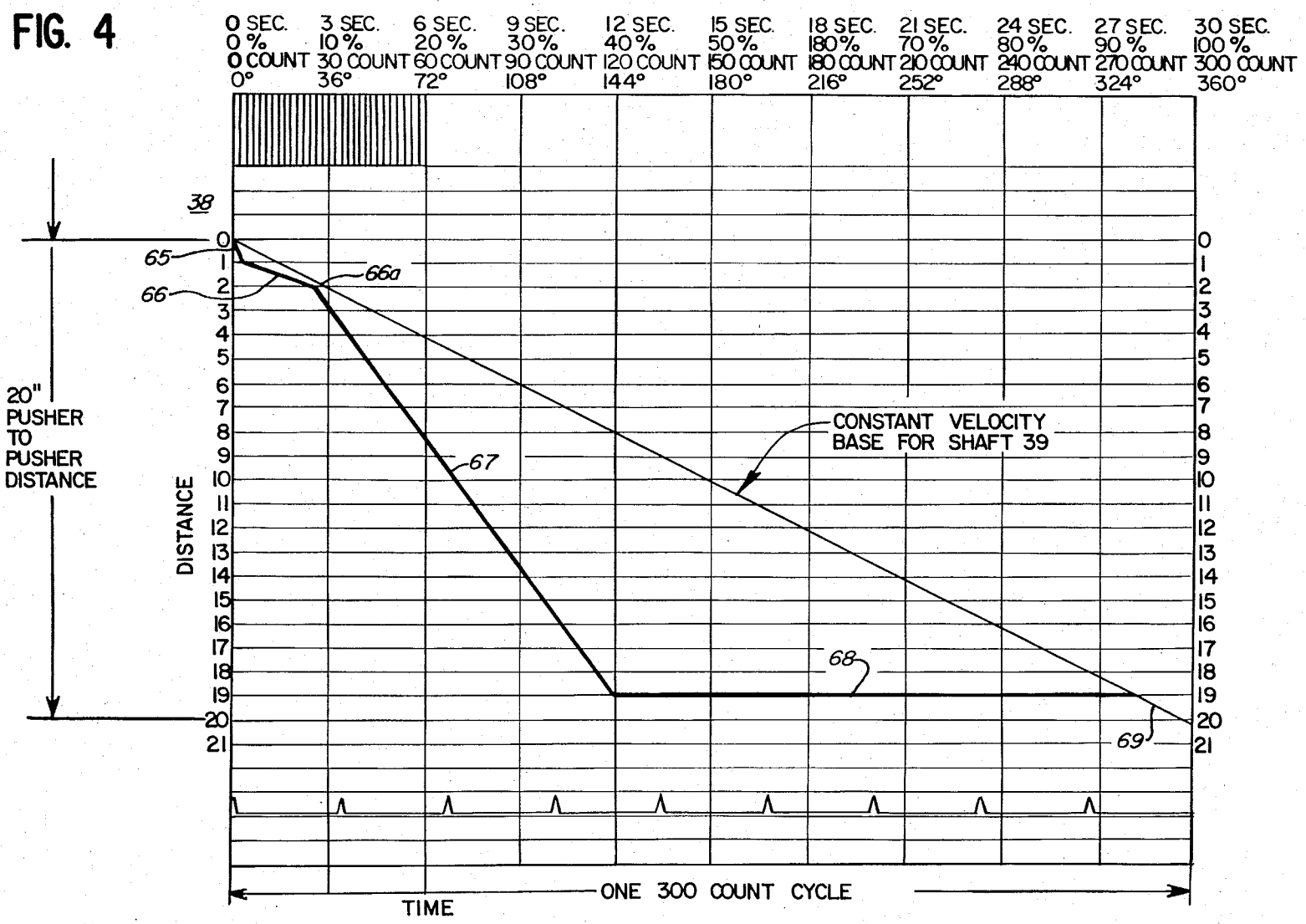
FIG. 4 is a timing chart which illustrates the various velocity segments of the delivery fingers for each cycle of stack formation.

FIG. 4 is a timing chart which illustrates the different velocity segments of the conveyor chains 33 and fingers 35 during one cycle or revolution of the control cam 49. The horizontal axis of the chart represents time, and the vertical axis represents the distance which the pusher fingers 35 move. In the embodiment represented by FIG. 4 the count or number of napkins in each stack is 300, and the pusher fingers 35 are spaced 20 inches apart on the conveyor chain.

Velocity segment 65 represents the relatively high velocity at which a finger is interjected between two consecutive napkins when a stack is completed on the magazine (finger **35*a* in FIG. 1). Interjection of a finger occurs directly after the last napkin that completes a predetermined count, which is 300 in the embodiment represented in FIG. 4**.

Subsequent napkins are delivered and packed behind the finger **35*a*, and the finger provides support against which the napkins can be packed. In order to provide space for subsequent napkins being packed, the conveyor chain and the fingers are moved forward at a different velocity segment 66 in FIG. 4. Velocity segment 66 corresponds to the rate at which napkins are packed by the packers 20** and continues until the quantity of napkins being stacked is sufficient to be held by stack-supporting devices on the magazine which will be described in detail hereinafter.

Position **66*a* in FIG. 4 represents the position of the finger 35*a* at which the partial stack which is being packed behind the finger is properly supported. At this point the finger 35*a* has moved one inch from the position at which velocity segment 66 began. The velocity of the conveyor chain and the fingers is then increased as indicated at 67 to move the finger 35*a* and the completed stack $S_1$ ahead of the finger 35*a* down the magazine. Forward motion of the conveyor chain and the fingers is stopped after the finger 35***a* has moved 17 inches during velocity segment 67, and the fingers and the completed stacks dwell as indicated by the zero velocity segment 68. During the dwell period a completed stack can be transferred from the magazine, for example by the transfer device 62. After the dwell period, the conveyor chain moves at velocity 69 to move the next finger into position to be interjected between two consecutive napkins for count separation of the stack which is being packed on the magazine.

It will be appreciated that when the partial stack which is being packed at the left end of the magazine in FIG. 1 becomes supported, the fingers move independently of the partial stack, and the packers 20 continue to pack the partial stack at a constant rate. The partial stack will not be contacted by the pusher fingers until the beginning 65 of the cycle represented in FIG. 4 when a pair of fingers is moved rapidly into the path of napkin movement to complete the count and separate the then completed stack from the next napkin.

At least two sets of finger pairs 35 are required for the foregoing cycle. However, most embodiments will utilize four or five sets of fingers fo proper stack transport and spacing.

The straight line 70 in FIG. 4 represents the constant velocity of the conveyor chain at the drive sprocket 38 which is rotated at a constant speed. The slopes of velocity segments 65 and 67 are greater than the slope of line 70, and during these segments the contour of the control cam 49 which engages the cam follower 52 is such that it moves the movable sprockets 41 and 42 so that the chain 47 travels over sprocket 37 faster than it is driven by the drive sprocket 38. The slope of velocity segment 66 is less than the slope of line 70, and during this segment the cam causes the chain 47 to travel over the sprocket 37 slower than it is driven by the drive sprocket 38. During velocity segment 68, the chain 47 and the sprocket 37 are stationary. During the velocity segment 69, the radius of the cam portion which engages the cam follower is constant, and the chain 47 travels over the sprocket 37 at the same speed at which it is driven by the drive sprocket.

Figure 3:
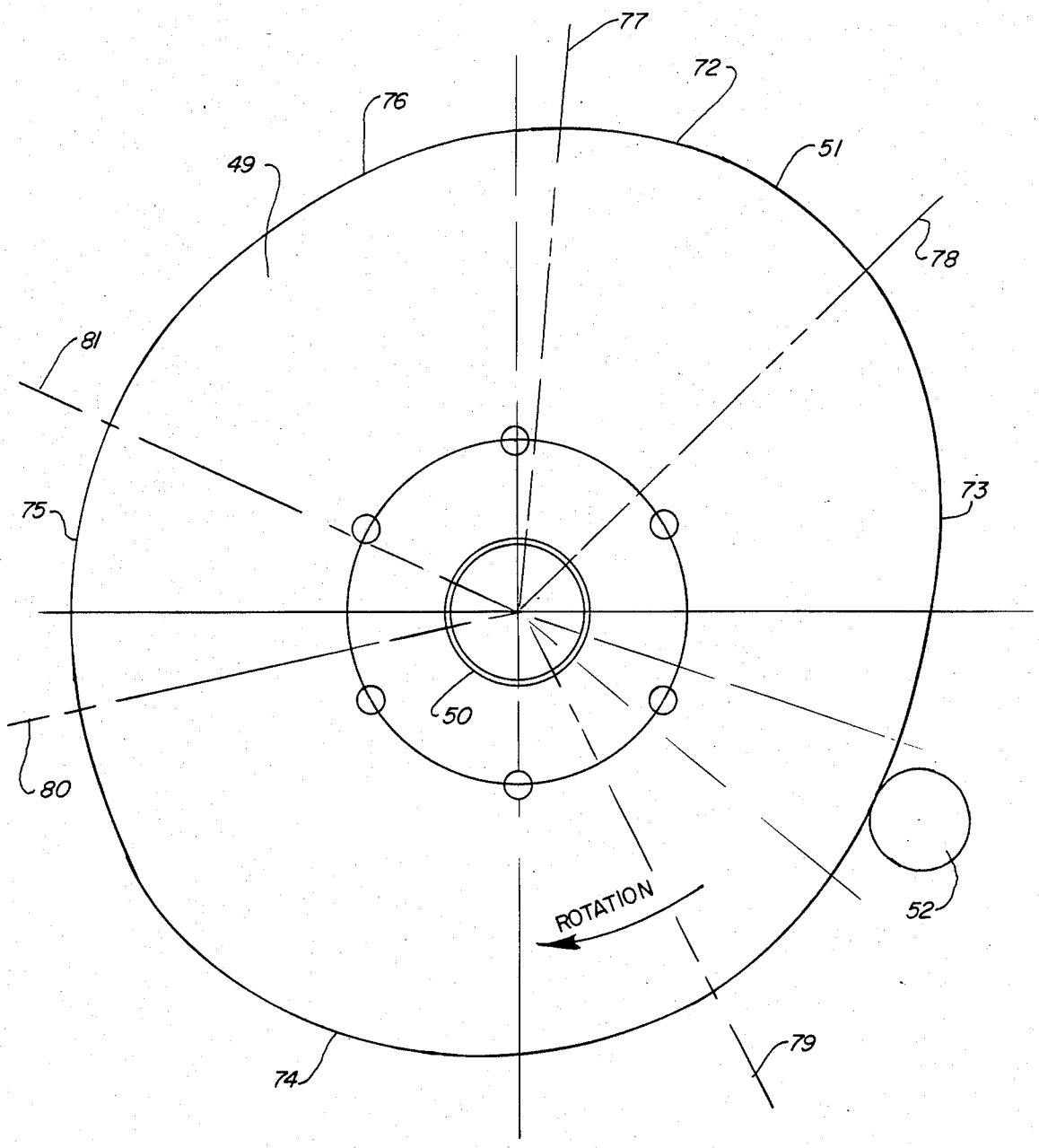
FIG. 3 is an enlarged elevational view of one of the cams for controling the drive system.

FIG. 3 illustrates one embodiment of a control cam 49 for achieving the five different velocity segments represented by the timing chart of FIG. 4. The periphery 51 of the cam includes five different camming portions 72 through 76 which engage the cam follower during each revoluton of the cam. The end points of the camming portions are indicated by the radial lines 77–81. The cam makes one revolution during the cycle represented in FIG. 4.

Figure 5:
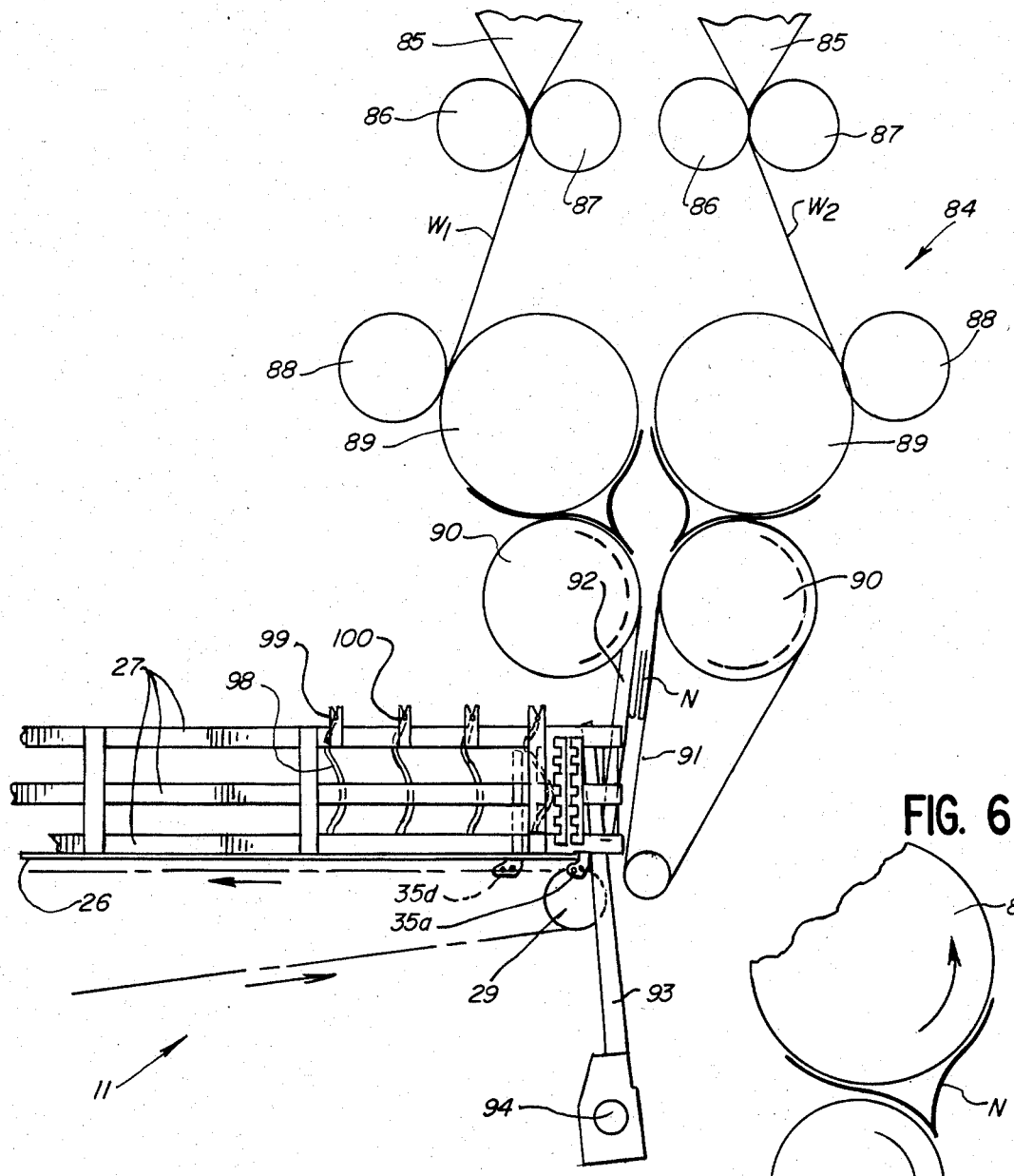
FIG. 5 is a fragmentary schematic illustration of a napkin folding machine which delivers two napkins at a time to the stacking and delivery machine.
Figure 6:
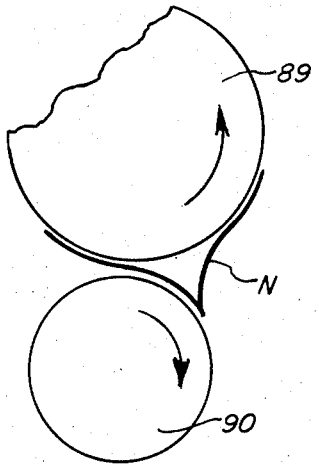
FIG. 6 is an enlarged fragmentary view of one of the pairs of folding rollers of FIG. 5.
Figure 7:
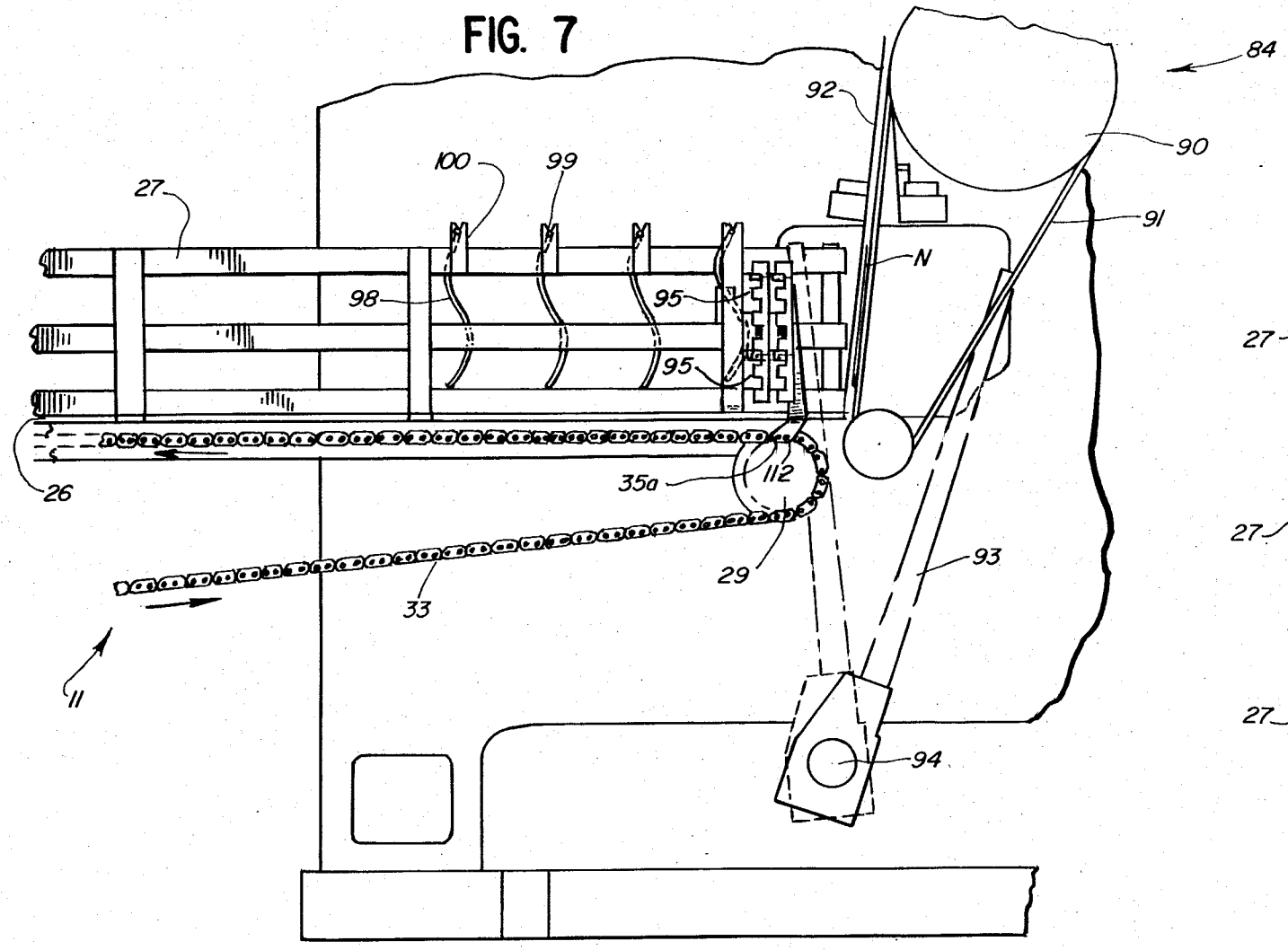
FIG. 7 is a view similar to FIG. 5 showing more of the details of the stacking and delivery machine.

FIG. 5–7 illustrate the automatic stacking and delivery apparatus 11 working in conjunction with a machine 84 having double the capacity of the converting machine 10 shown in FIG. 1. In FIGS. 5–7 a two-wide web W is split into individual strands W1 and W2, each of which pass sequentially through or over various devices such as longitudinal folding plate 85, nip rolls 86 and 87, cutoff roll 88, anvil/vacuum carrier roll 89, and folding roll 90. The napkins N are stripped from the folding rolls by belts 91 which ride in grooves in the folding rolls, and the napkins move downwardly in superposed pairs between the belts 91 and a guide strip 92 until they are positioned for pack out by packer fingers 93 which reciprocate about shaft 94. The machine 84 is a conventional Super 6 machine available from Paper Converting Machine Company.

In FIG. 5 a pair of pusher fingers 35*a* have been rotated by the sprocket 29 to a vertical position in front of the delivery belts. In this position, a completed stack would be to the left of the fingers 35*a* and the next stack would be packed against the right side of fingers 35*a*.

Figure 8:
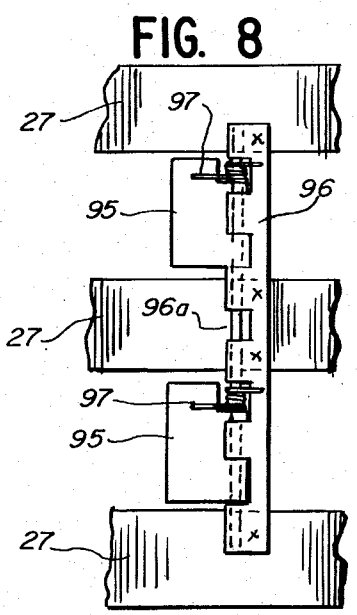
FIG. 8 is an enlarged fragmentary view of a portion of FIG. 7.

From position 35*a* to the position illustrated in phantom at 35*d*, the fingers 35*a* move at a velocity equal to the rate of stack build-up. A plurality of pivoted support plates 95 (see also FIG. 8) are urged against the vertical side edges of the napkin stack to help maintain the stack in an upright position and provide some resistance against the force of the packing fingers 93. In FIG. 8 the support plates 95 are supported by a piano hinge plate 96 which is attached to the side rails 27 on each side of the magazine. The plates are mounted on a hinge pin 96*a* and are resiliently biased toward the stack by springs 97. Each of the support plates can pivot into engagement with the stack between the side rails 27 of the magazine.

A plurality of S-curved support fingers 98 are suspended from rods 99 which are pivotally supported by brackets 100 on the sides of the magazine. Two or more support fingers are suspended from each rod. The support fingers contact the upper front portion of the stack as it is built up and moved down the magazine.

Once the partial stack is built up to finger position 35*d* and is under the control of the side support plates 95 and the top support fingers 98, the pusher fingers and the completed stack in front of the pusher fingers can move rapidly forward to transport the completed stack out of the general proximity of the packer. This occurs during the previously described velocity segment 67 of FIG. 4, after which the completed stack will be stopped for subsequent transfer or handling during the dwell segment 68.

Figure 9:
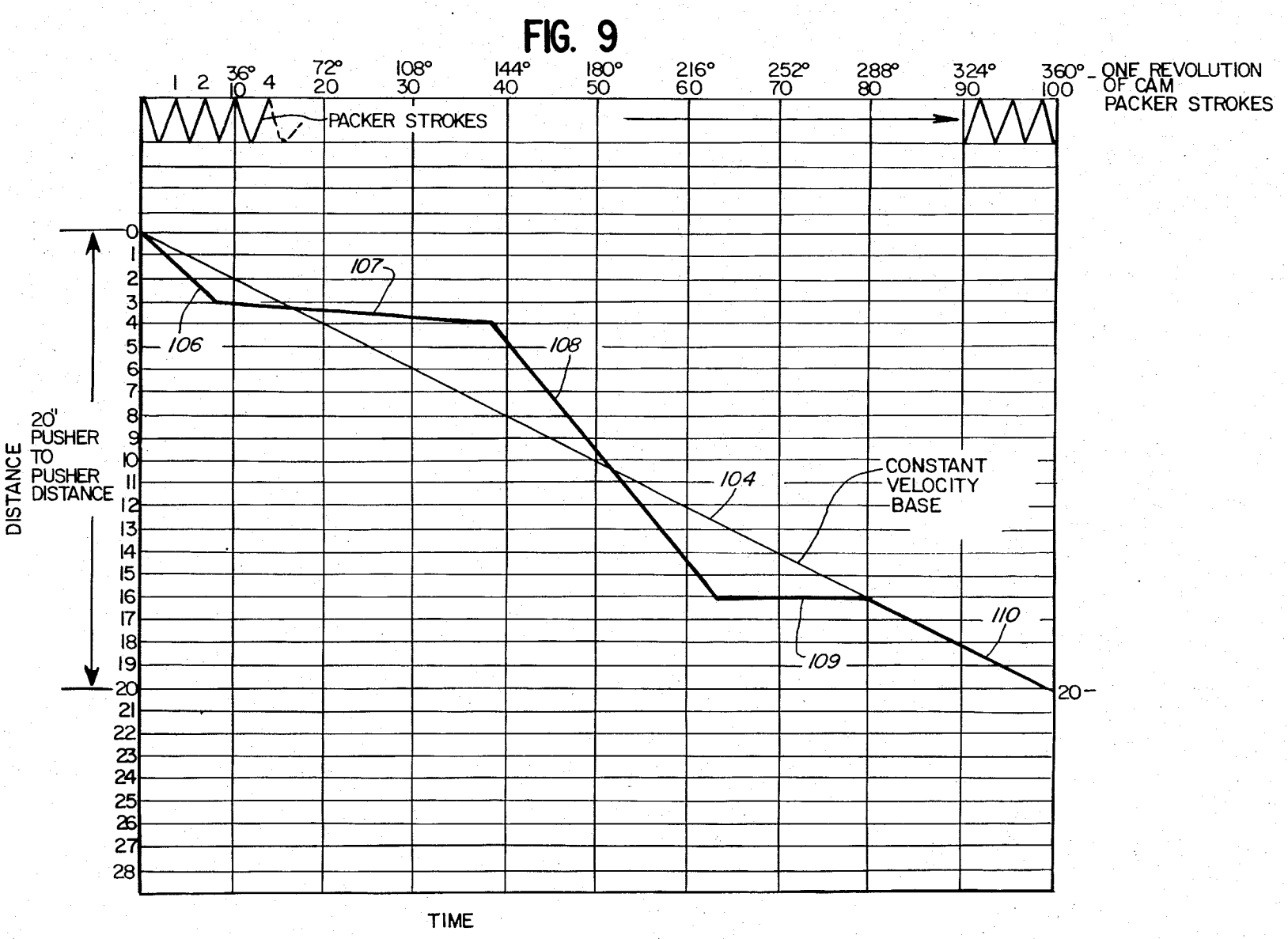
FIGS. 9 and 10 are timing charts, similar to FIG. 3, which illustrate the velocity segments for two other control cams.

FIG. 9 is a timing chart illustrating the velocity curves used for the napkin folding machine 84 of FIG. 5. For the machine illustrated in FIG. 1 and the timing chart of FIG. 4, the total productivity is at least 600 napkins per minute per lane. The productivity of the machine 84 is at least 1200 napkins per minute per lane.

In FIG. 9 certain velocity segments are below and others are above the constant velocity base speed of the drive sprocket 38 which is represented by the straight line 104. This means that in the speed changing system of FIG. 2, the movable sprocket 41 will be moved in one direction by the control cam 49 when a given velocity segment is greater than the constant velocity base speed and will move in the other direction when the velocity segment is below the constant velocity base speed.

During the first velocity segment 106, the conveyor chain and pusher fingers are moved rapidly to move one of the pairs of fingers behind a completed stack. The conveyor chain and pusher fingers then move at a slower velocity 107 as the next stack is built up. When the partial stack becomes self-supporting, the conveyor chain and pusher fingers move rapidly during velocity segment 108 to move the completed stack downstream. The completed stack is removed during the dwell segment 109, and the fingers thereafter are moved at velocity 110 to bring a finger into position for count separation. Count separation occurs at the beginning of the next cycle during velocity segment 106.

The timing chart of FIG. 9 is for a 60 count stack. Since the napkin folding machine 84 delivers 1200 napkins per lane per minute to the stacking and delivery machine, the cycle for 60 count stacks is 20 stacks per minute or three seconds for each cycle. The time along the horizontal axis of FIG. 9 is therefore three seconds for the complete cycle.

Figure 10:
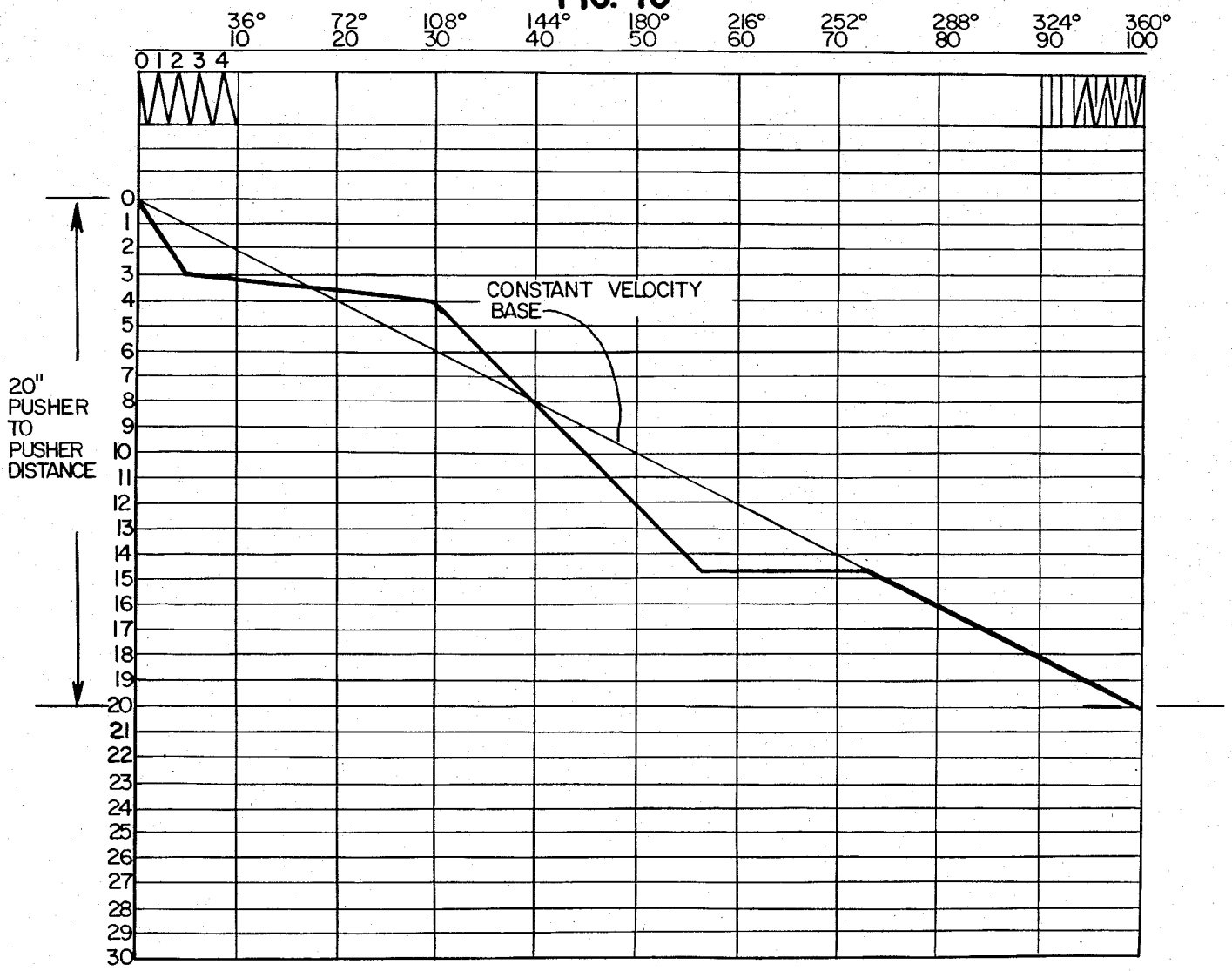

FIG. 10 is a timing chart similar to FIG. 9 for a 100 count stack.

Figure 11:
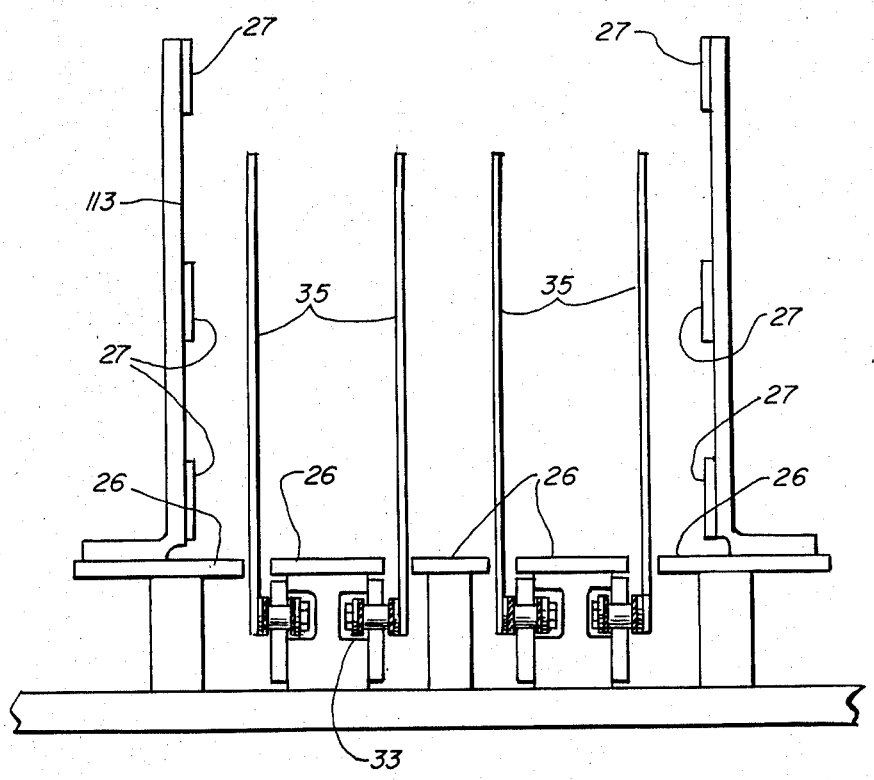
FIG. 11 is an enlarged sectional view taken along the line 11—11 of FIG. 2.

In the embodiment illustrated, each of the pusher fingers 35 is connected to the conveyor chain 33 by a pair of pins 112 (FIGS. 7 and 11) which connect the links of the chain. FIG. 11 illustrates one lane of a multiple lane stacking machine. The stacks of each lane are moved between the side plates 27 which are supported by vertical posts 113. Four chains 33 extend below each lane of the magazine, and the pusher fingers 35 are arranged in sets of four which are spaced transversely across the magazine.

Although the specific embodiment of FIG. 2 uses chains 47 and sprockets 37, 41, 38 and 42 for changing velocity of the pusher fingers, it will be understood that other drive means could be used, for example, belts and pulleys or the like. Accordingly, the terms "chain" and "sprocket" as used herein and in the following claims are meant to include equivalent devices such as belts and pulleys.

While the particular velocity modifying mechanism which is described in the application includes a cam, cam follower, linkages, movable sprockets, etc., equivalent means can be utilized to accomplish the same function. For example, a servo motor can be programmed for different velocities during one count cycle.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. An apparatus for stacking and delivering a stack consisting of a plurality of products comprising:

(a) a frame, (b) a magazine on the frame for supporting a plurality of said products along a path of product movement, (c) a conveyor on the frame adjacent the magazine, the conveyor having a run which extends in the direction of said path, (d) a plurality of fingers mounted on the conveyor and engageable with stacks on the magazine for moving the stacks along said path, (e) drive means for moving the conveyor at:

(i) a relatively slow velocity during an initial build-up period for a new stack whereby the new stack is built up behind one of said fingers during said initial build-up period;

(ii) a relatively fast velocity after the initial build-up period for the new stack whereby said one finger moves away from the new stack and moves a previously completed stack along said path at a faster speed than the speed at which the new stack is built up; and (f) means for supporting the new stack on the magazine when said one finger moves away from the new stack after said initial build-up period whereby said new stack can be built up after said initial build-up period without being engaged by any of said fingers and while said one finger moves said previously completed stack away from the new stack.

2. The apparatus of claim 1 in which each of said stacks consists of a predetermined number of said products, said one finger being movable into said path by the conveyor after said predetermined number of products is on the magazine whereby consecutive stacks on the magazine are separated by said one finger.

3. The apparatus of claim 1 in which said drive means moves the conveyor at a first velocity when said one finger is moved by the conveyor into said path and at a different velocity when said one finger is moved along said path.

4. The apparatus of claim 3 in which said drive means stops the conveyor when said one finger reaches a predetermined location along said path whereby a stack which is engaged by said one finger can be removed from the path.

5. The apparatus of claim 1 in which said drive means moves the conveyor at a first velocity when said one finger is moved by the conveyor into said path, at a second velocity which is slower than the first velocity when said one finger first moves along said path, and at a third velocity which is faster than the second velocity as said one finger continues to move along said path.

6. The apparatus of claim 5 in which said drive means stops the conveyor when said one finger reaches a predetermined location along saidpath whereby a stack which is engaged by said one finger can be removed from the path.

7. The apparatus of claim 1 in which said supporting means includes stack-supporting plates hingedly mounted on the frame on opposite sides of the magazine and means resiliently biasing the supporting plates into engagement with the sides of the products as a stack is built up.

8. The apparatus of claim 7 in which said biasing means for each support plate is a spring mounted on the hinge for the plate.

9. The apparatus of claim 1 in which said supporting means includes a stack-restraining means mounted on the frame above the magazine for engagement with the products as a stack is built up.

10. An apparatus for stacking and delivering a stack consisting of a plurality of products comprising:

(a) a frame, (b) a magazine on the frame for supporting a plurality of said products along a path of product movement, (c) a conveyor on the frame adjacent the magazine, the conveyor having a run which extends in the direction of said path, (d) a plurality of fingers mounted on the conveyor and engageable with stacks on the magazine for moving the stacks along said path, and (e) drive means for moving the conveyor at varying velocities during build-up and transport of a stack on the magazine, said drive means including a first sprocket drivingly connected to the conveyor for advancing the conveyor in the direction of said path, a drive sprocket mounted on the frame, power means for rotating the drive sprocket, a pair of movable sprockets movably mounted on the frame for movement toward and away from each other, a chain extending around said sprockets, and means for moving said movable sprockets toward and away from each other to change the speed at which the chain travels over the first sprocket relative to the speed at which the chain travels over the drive sprocket.

11. The apparatus of claim 10 in which both of said movable sprockets are positioned on one side of a line extending between the first sprocket and the drive sprocket and said chain extends from said drive sprocket around one of said movable sprockets, around said first sprocket, around the other movable sprocket, and around the drive sprocket.

12. The apparatus of claim 10 in which said means for moving the movable sprocket includes a cam rotatably mounted on the frame, a cam follower engageable with the cam, and links connecting the cam follower and one of the movable sprockets whereby movement of the cam follower causes movement of the links and said one movable sprocket.

13. The apparatus of claim 12 in which said one movable sprocket is rotatably mounted on a lever which is pivotally mounted on the frame, said links being connected to the lever for pivoting the lever.

14. The apparatus of claim 13 in which the other movable sprocket is rotatably mounted on a second lever which is pivotally mounted on the frame.

15. The apparatus of claim 12 in which the cam has a first camming portion which engages the cam follower when a finger is moved by the conveyor into said path to move said one movable sprocket so that the chain travels over the first sprocket faster than it travels over the drive sprocket and the finger is moved quickly into said path to engage a completed stack, a second camming portion which engages the cam follower after the finger has engaged the completed stack to move said one movable sprocket so that the chain travels over the first sprocket slower than it travels over the drive sprocket and the finger moves the completed stack along the path at a first velocity, and a third camming portion which engages the cam follower after a partial stack is built up behind the finger to move said one movable sprocket so that the chain travels over the first sprocket faster than the chain travels over the drive sprocket and the finger moves the completed stack along the path at a second velocity which is faster than the first velocity.

16. The apparatus of claim 15 in which the cam has a fourth camming portion which engages the cam follower when the completed stack reaches a predetermined position along said path to move said one movable sprocket so that the chain remains stationary relative to the first sprocket and the finger and the completed stack are stationary.

17. The apparatus of claim 16 in which the cam has a fifth camming portion which engages the cam follower after the completed stack is stationary so that the chain is moved to bring a finger into position to be moved into said path.

18. The apparatus of claim 16 in which said drive means moves the conveyor at a third velocity after the conveyor is stopped to move a finger into position to be moved into said path.

* * * * *